US008063578B2

(12) United States Patent
Sanchez

(10) Patent No.: US 8,063,578 B2
(45) Date of Patent: Nov. 22, 2011

(54) METHOD AND FIRMWARE FOR GENERATING A DIGITAL DIMMING WAVEFORM FOR AN INVERTER

(75) Inventor: Jorge Sanchez, Poway, CA (US)

(73) Assignee: Tecey Software Development KG, LLC, Dover, DE (US)

( * ) Notice: Subject to any disclaimer, the term of this patent is extended or adjusted under 35 U.S.C. 154(b) by 628 days.

(21) Appl. No.: 12/042,720

(22) Filed: Mar. 5, 2008

(65) Prior Publication Data

US 2008/0315794 A1 Dec. 25, 2008

Related U.S. Application Data

(60) Provisional application No. 60/893,097, filed on Mar. 5, 2007.

(51) Int. Cl.
*G05F 1/00* (2006.01)

(52) U.S. Cl. ..... 315/291; 315/224; 315/307; 315/360; 315/312; 315/149

(58) Field of Classification Search ..... 315/312, 315/314, 316, 318, 308, 307, 291, 207, 224, 315/324, 209 R, 276, 360, 149; 345/102, 345/207

See application file for complete search history.

(56) References Cited

U.S. PATENT DOCUMENTS 5,334,916 A * 8/1994 Noguchi ..... 315/309
6,127,783 A * 10/2000 Pashley et al. ..... 315/149
6,344,641 B1 * 2/2002 Blalock et al. ..... 250/205
6,441,558 B1 * 8/2002 Muthu et al. ..... 315/149
6,448,550 B1 * 9/2002 Nishimura ..... 250/226
6,922,023 B2 * 7/2005 Hsu et al. ..... 315/291
7,151,346 B2 * 12/2006 Sanchez ..... 315/308
7,332,869 B2 * 2/2008 Yoo et al. ..... 315/224
2005/0146290 A1 7/2005 Gray
2006/0009822 A1 1/2006 Savage et al.
2006/0232222 A1 10/2006 Liu et al.
2007/0001617 A1 1/2007 Pogodayev et al.

OTHER PUBLICATIONS

Search Report dated Jul. 23, 2008 for PCT application No. PCT/US08/55966 (WO/2008/109710).

Written Opinion for PCT/US2008/055966, mailed Jul. 23, 2008.

International Preliminary Report on Patentability for PCT/US2008/055966, mailed Sep. 8, 2009.

* cited by examiner

*Primary Examiner* — Haissa Philogene

(74) *Attorney, Agent, or Firm* — Schwabe, Williamson & Wyatt, P.C.

(57) ABSTRACT

A method and firmware for method of generating a digital dimming waveform for an inverter includes steps of receiving programmable parameters as input to firmware in an inverter voltage microcontroller including a soft start duration, a restrike voltage, a restrike duration, a recovery duration, a sustaining voltage, a dimming duty cycle, and an inverter frequency; and generating by firmware in the inverter voltage microcontroller a first portion of a pulse-width modulated digital switch control signal having a frequency equal to the inverter frequency and a duty cycle that varies from a first value to a second value during a time interval equal to the soft start duration.

29 Claims, 5 Drawing Sheets

METHOD AND FIRMWARE FOR GENERATING A DIGITAL DIMMING WAVEFORM FOR AN INVERTER

CROSS-REFERENCES TO RELATED APPLICATIONS

This application claims the benefit of U.S. Provisional Application No. 60/893,097 filed on Mar. 5, 2007, entitled METHOD AND FIRMWARE FOR GENERATING A DIGITAL DIMMING WAVEFORM FOR AN INVERTER, which is hereby expressly incorporated by reference in its entirety for all purposes.

BACKGROUND OF THE INVENTION

1. Field of the Invention

The present invention is directed to controlling arrays of fluorescent lamps. More specifically, but without limitation thereto, the present invention is directed to a method and firmware for generating a digital dimming waveform for an inverter in a fluorescent lamp array.

2. Description of Related Art

Fluorescent lamp arrays are typically incorporated into backlights for liquid crystal displays (LCD), for example, in computers and television receivers. The voltage for the fluorescent lamps is typically generated by an inverter circuit that switches a DC voltage to produce an alternating current in the primary winding of a voltage step-up transformer. A dimming signal, typically represented by an analog voltage signal, is used to vary the time that the fluorescent lamp array is switched on and off to adjust the brightness of the array.

SUMMARY OF THE INVENTION

In one embodiment, a method of generating a digital dimming waveform for an inverter includes steps of:

receiving programmable parameters as input to firmware in an inverter voltage microcontroller including a soft start duration, a restrike voltage, a restrike duration, a recovery duration, a sustaining voltage, a dimming duty cycle, and an inverter frequency; and generating by firmware in the inverter voltage microcontroller a first portion of a pulse-width modulated digital switch control signal having a frequency equal to the inverter frequency and a duty cycle that varies from a first value to a second value during a time interval equal to the soft start duration.

In another embodiment, a method of generating a startup waveform for an inverter includes steps of:

receiving parameters as input to firmware in an inverter voltage microcontroller including a soft start duration, a strike voltage, a strike duration, a recovery duration, a sustaining voltage, and an inverter frequency; and generating by firmware in the inverter voltage microcontroller a first portion of a pulse-width modulated digital switch control signal having a frequency equal to the inverter frequency and a duty cycle that varies from a first value to a second value during a time interval equal to the soft start duration, the second value of the duty cycle selected to generate the strike voltage.

BRIEF DESCRIPTION OF THE DRAWINGS

The above and other aspects, features and advantages will become more apparent from the description in conjunction with the following drawings presented by way of example and not limitation, wherein like references indicate similar elements throughout the several views of the drawings, and wherein.

Elements in the figures are illustrated for simplicity and clarity and have not necessarily been drawn to scale. For example, the dimensions, sizing, and/or relative placement of some of the elements in the figures may be exaggerated relative to other elements to clarify distinctive features of the illustrated embodiments. Also, common but well-understood elements that may be useful or necessary in a commercially feasible embodiment are often not depicted in order to facilitate a less obstructed view of the illustrated embodiments.

DESCRIPTION OF THE ILLUSTRATED EMBODIMENTS

The following description is not to be taken in a limiting sense, rather for the purpose of describing by specific examples the general principles that are incorporated into the illustrated embodiments. For example, certain actions or steps may be described or depicted in a specific order to be performed. However, practitioners of the art will understand that the specific order is only given by way of example and that the specific order does not exclude performing the described steps in another order to achieve substantially the same result. Also, the terms and expressions used in the description have the ordinary meanings accorded to such terms and expressions in the corresponding respective areas of inquiry and study except where other meanings have been specifically set forth herein. The term "firmware" is used interchangeably with and means the same as the phrase "a computer readable storage medium tangibly embodying instructions that when executed by a computer implement a method".

Previously, discrete analog components have been used in inverters to generate the timing frequencies and voltage levels used to drive fluorescent lamp arrays. However, as the performance requirements for fluorescent lamp arrays become more stringent with regard to maintaining a light output within a narrow tolerance for each fluorescent lamp, the instability of analog component behavior due to varying operating temperature, manufacturing variations, and aging becomes a problem. Another problem found in inverters is that the inverter voltage varies as a function of frequency according to a transfer function that is dependent on the resistance, capacitance, and inductance of the components in the inverter and in the load being driven by the inverter.

Figure 1:
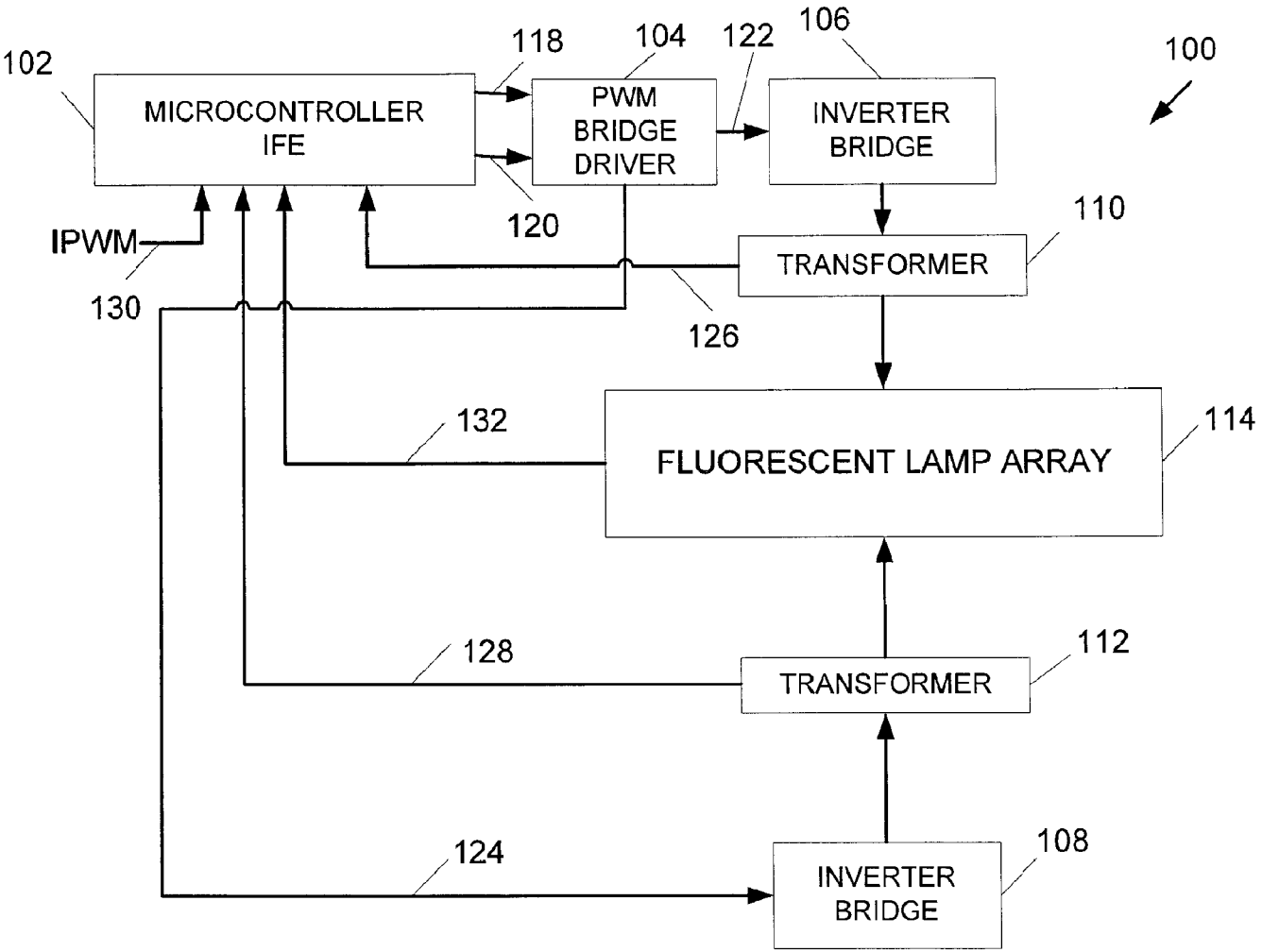
FIG. 1 illustrates a block diagram of a microcontroller circuit for controlling voltage and current in a fluorescent lamp array.

FIG. 1 illustrates a block diagram of a microcontroller circuit 100 for controlling voltage and current in a fluorescent lamp array. Shown in FIG. 1 are an inverter voltage microcontroller 102, a pulse-width modulation (PWM) bridge driver 104, inverter bridges 106 and 108, inverter transformers 110 and 112, an array of fluorescent lamps 114, a load current microcontroller 116, digital switch control signals 118 and 120, switching signals 122 and 124, voltage feedback signals 126 and 128, a dimming control signal (IPWM) 130, and a load feedback signal 132.

The microcontroller circuit 100 includes two inverters to provide left-to-right brightness balance for large displays and to halve the inverter voltage required from each inverter, advantageously reducing high voltage hazards such as arcing in the transformer and in components on the circuit board on which the components of the microcontroller circuit 100 are mounted. Alternatively, a single inverter may be used to practice other embodiments within the scope of the appended claims.

In FIG. 1, the inverter voltage microcontroller 102 may be implemented, for example, as an integrated circuit microcomputer that can execute instructions from firmware located on-chip. The firmware in the inverter voltage microcontroller 102 is also referred to herein as the inverter firmware engine (IFE). The pulse-width modulation (PWM) bridge driver 104 may be implemented, for example, as a digital circuit that receives the digital switch control signals 118 and 120 from the inverter voltage microcontroller 102 and generates the switching signals 122 and 124 for the inverter bridges 106 and 108, respectively. The PWM inverter bridge driver 104 is connected directly to a digital output port of the inverter voltage microcontroller 102 and preferably does not include analog timing components. The inverter bridge 106 may be implemented, for example, as an H-bridge, or full bridge, using common digital switching components. The inverter transformers 110 and 112 may each be implemented, for example, as a pair of transformers connected in parallel to reduce the height of a circuit board used to mount the components of the microcontroller circuit 100. The fluorescent lamps 114 may be implemented, for example, as any type of light-emitting device driven by an inverter, including cold-cathode fluorescent lamps (CCFL) and external electrode fluorescent lamps (EEFL).

In operation, the inverter voltage microcontroller 102 sets the inverter voltage output from each of the inverter transformers 110 and 112 to strike the array of fluorescent lamps 114 and to maintain sufficient load current through each of the fluorescent lamps 114 to provide the desired light output. The load current may be measured and included in the load feedback signal 132 according to well-known techniques. Other parameters such as the temperature of the fluorescent lamps 114 may also be included in the load feedback signal 132. The inverter voltage output from each of the inverter transformers 110 and 112 may be measured, for example, from a voltage divider and digitized according to well-known techniques to generate the voltage feedback signals 126 and 128.

Figure 2:
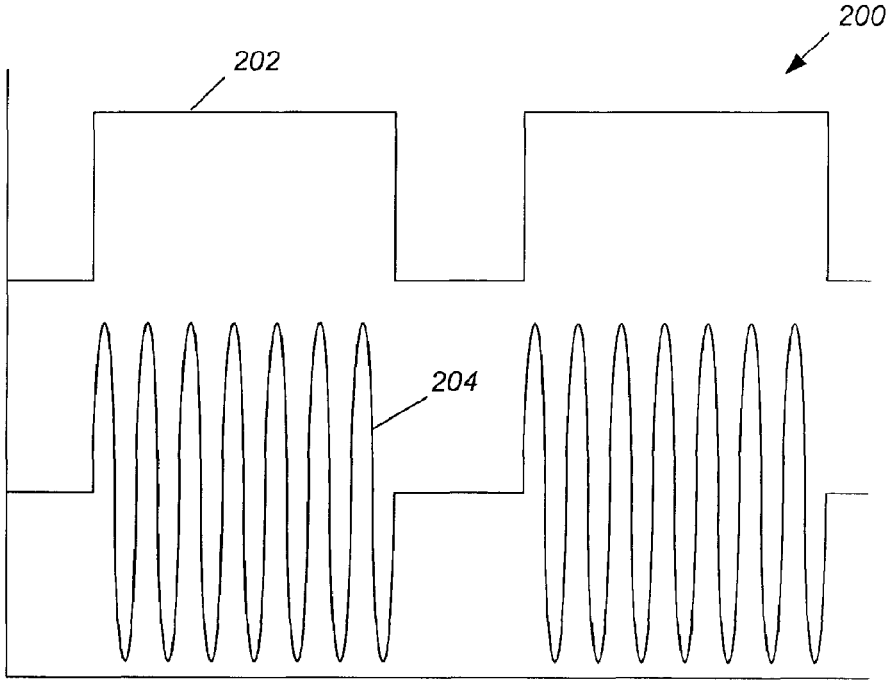
FIG. 2 (PRIOR ART)
FIG. 2 illustrates a timing diagram of a dimming cycle of the prior art.

FIG. 2 illustrates a timing diagram 200 of a dimming cycle of the prior art. Shown in FIG. 2 are a pulse-width modulated digital dimming signal 202 and a dimming signal waveform 204.

In FIG. 2, the pulse-width modulated digital dimming signal 202 is generated from the analog voltage input IPWM in FIG. 1. The dimming signal waveform 204 has a constant amplitude equal to the sustaining voltage of the fluorescent lamp array 114 in FIG. 1 during the ON time of the digital dimming signal 202 and zero amplitude during the OFF time. A disadvantage of the dimming signal waveform 204 is that the abrupt amplitude shifts at the ON/OFF transitions results in transformer noise. The noise may be attenuated by potting the windings; however, potting adds cost and manufacturing time to production. A preferable alternative is to provide a smooth transition between voltage levels that avoids transformer noise without potting the windings.

Figure 3:
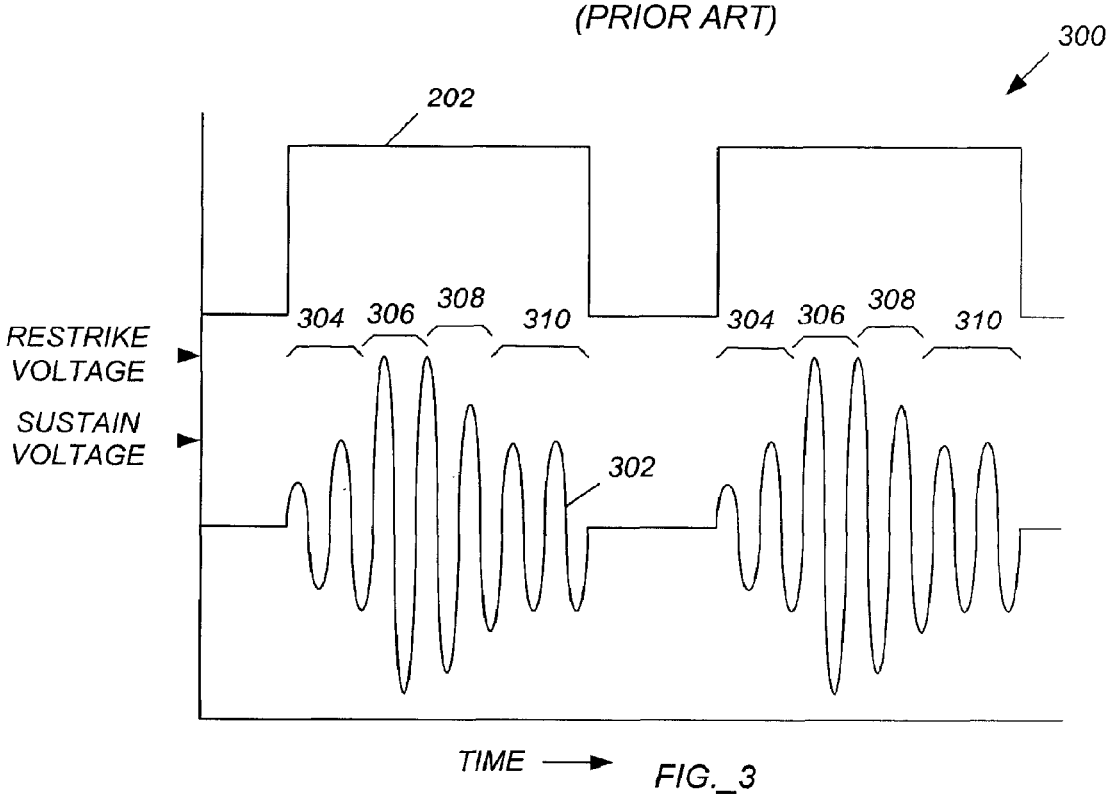
FIG. 3 illustrates a timing diagram of a dimming cycle with smoothed voltage transitions.

FIG. 3 illustrates a timing diagram 300 of a dimming cycle with smoothed voltage transitions. Shown in FIG. 2 are a pulse-width modulated digital dimming signal 202, a smoothed dimming signal waveform 302, a soft start duration 304, a restrike duration 306, a recovery duration 308, and a sustained duration 310.

In FIG. 3, the inverter firmware engine (IFE) in FIG. 1 generates the smoothed dimming signal waveform 302 by controlling the duty cycle of one or both of the pulse-width modulated digital switch control signals 118 and 120 in FIG. 1. During the soft start duration 304, the inverter voltage sweeps from, for example, zero volts to the restrike voltage. During the restrike duration 306, the inverter voltage is maintained at the restrike voltage of the fluorescent lamp array 114. During the recovery duration 308, the inverter voltage sweeps from the restrike voltage of the fluorescent lamp array 114 to the sustaining voltage. During the sustained duration 310, the inverter voltage is maintained at the sustaining voltage of the fluorescent lamp array 114.

Figure 4:
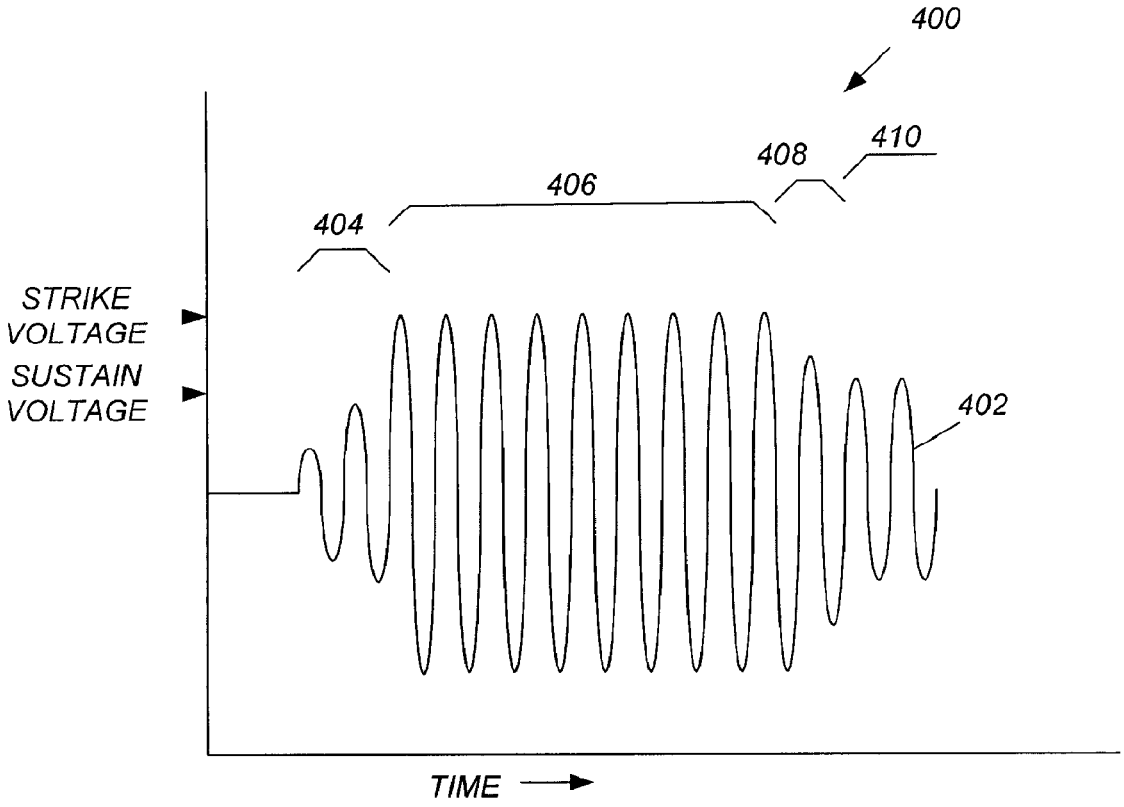
FIG. 4 illustrates a timing diagram of a startup cycle with smoothed voltage transitions.

FIG. 4 illustrates a timing diagram 400 of a startup cycle with smoothed voltage transitions. Shown in FIG. 4 are a smoothed startup cycle signal waveform 402, a soft start duration 404, a strike duration 406, a recovery duration 408, and a sustained duration 410.

In FIG. 4, the inverter firmware engine (IFE) in FIG. 1 generates the smoothed startup cycle signal waveform 402 by controlling the duty cycle of one or both of the pulse-width modulated digital switch control signals 118 and 120 in FIG. 1. During the soft start duration 404, the inverter voltage sweeps from, for example, zero volts to the strike voltage. During the strike duration 406, the inverter voltage is maintained at the strike voltage of the fluorescent lamp array 114. During the recovery duration 408, the inverter voltage sweeps from the strike voltage of the fluorescent lamp array 114 to the sustaining voltage. During the sustained duration 410, the inverter voltage is maintained at the sustaining voltage of the fluorescent lamp array 114.

Figure 5:
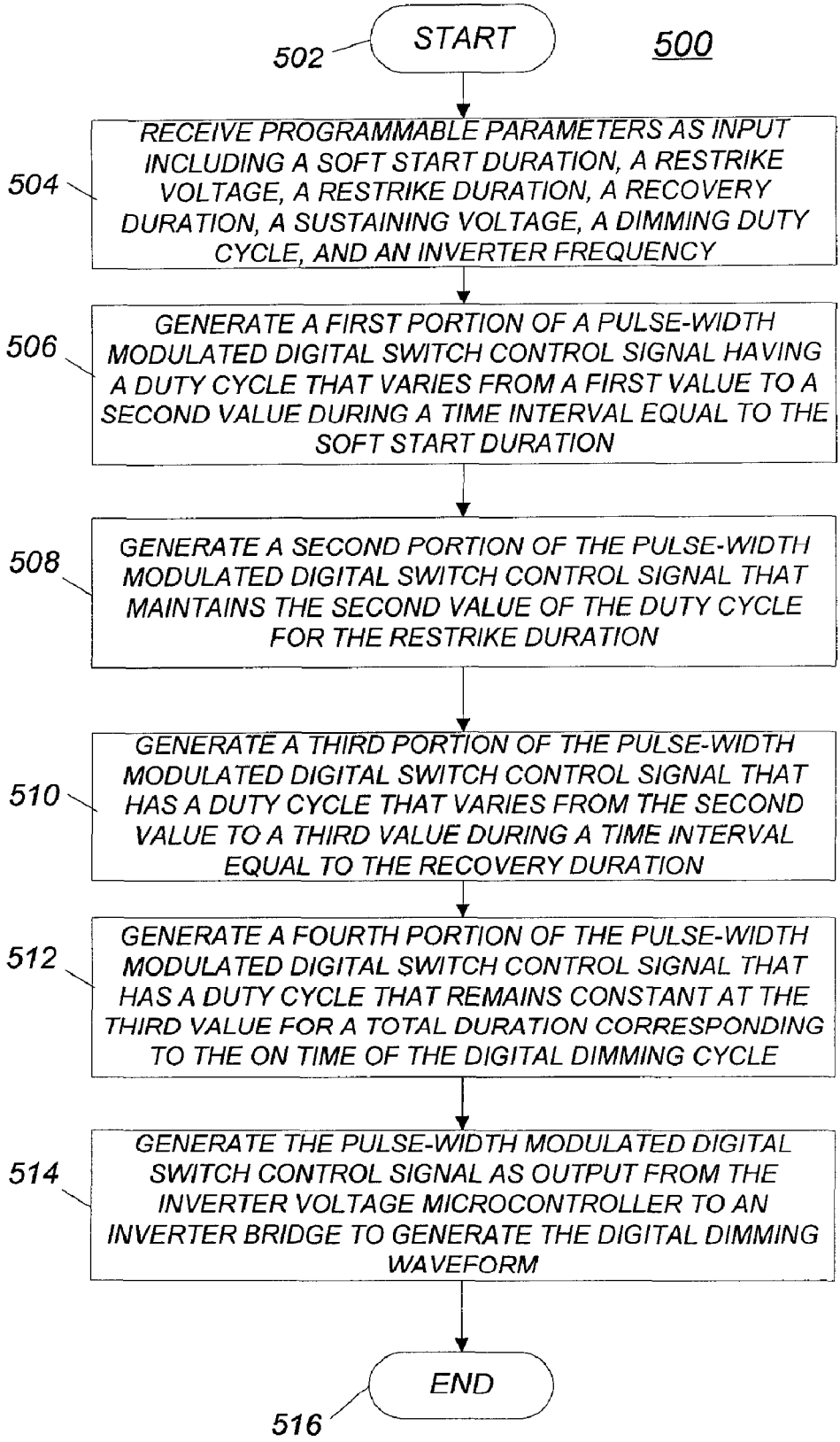
FIG. 5 illustrates a flow chart for a method of generating the dimming waveform of FIG. 3.

FIG. 5 illustrates a flow chart 500 for a method of generating the dimming waveform of FIG. 3.

Step 502 is the entry point of the flow chart 500.

In step 504, the inverter firmware engine (IFE) receives programmable parameters as input including a soft start duration, a restrike voltage, a restrike duration, a recovery duration, a sustaining voltage, a dimming duty cycle, and an inverter frequency. The programmable parameters may be retrieved, for example, from a calibration database stored in the IFE.

In step 506, the inverter firmware engine (IFE) generates a first portion of a pulse-width modulated digital switch control signal having a frequency equal to the inverter frequency and a duty cycle that varies from a first value to a second value during a time interval equal to the soft start duration 304 in FIG. 3. For example, the first value of the duty cycle may be zero and the second value may be the restrike voltage. The modulation of the duty cycle envelope from the first value to the second value may be linear or non-linear.

In step 508, the inverter firmware engine (IFE) generates a second portion of the pulse-width modulated digital switch control signal that continues from the first portion. The second portion maintains the second value of the duty cycle for the restrike duration 306.

In step 510, the inverter firmware engine (IFE) generates a third portion of the pulse-width modulated digital switch control signal that continues from the second portion. The third portion has a duty cycle that varies from the second value to a third value during a time interval equal to the recovery duration 308. The third value of the duty cycle is selected to generate the sustaining voltage.

In step 512, the inverter firmware engine (IFE) generates a fourth portion of the pulse-width modulated digital switch control signal that continues from the third pulse-width modulated digital switch control signal. The fourth portion has a duty cycle that remains constant at the third value for the duration 310 calculated so that the first, second, third, and fourth portions of the pulse-width modulated digital switch control signal have a total duration corresponding to the ON time of the digital dimming cycle.

In step 514, the inverter firmware engine (IFE) generates the pulse-width modulated digital switch control signal as output from the inverter voltage microcontroller to an inverter bridge to generate the digital dimming waveform.

Step 516 is the exit point of the flow chart 500.

In another embodiment, a method of generating a startup waveform for an inverter includes steps of:

receiving parameters as input to firmware in an inverter voltage microcontroller including a soft start duration, a strike voltage, a strike duration, a recovery duration, a sustaining voltage, and an inverter frequency; and generating by firmware in the inverter voltage microcontroller a first portion of a pulse-width modulated digital switch control signal having a frequency equal to the inverter frequency and a duty cycle that varies from a first value to a second value during a time interval equal to the soft start duration, the second value of the duty cycle selected to generate the strike voltage.

Figure 6:
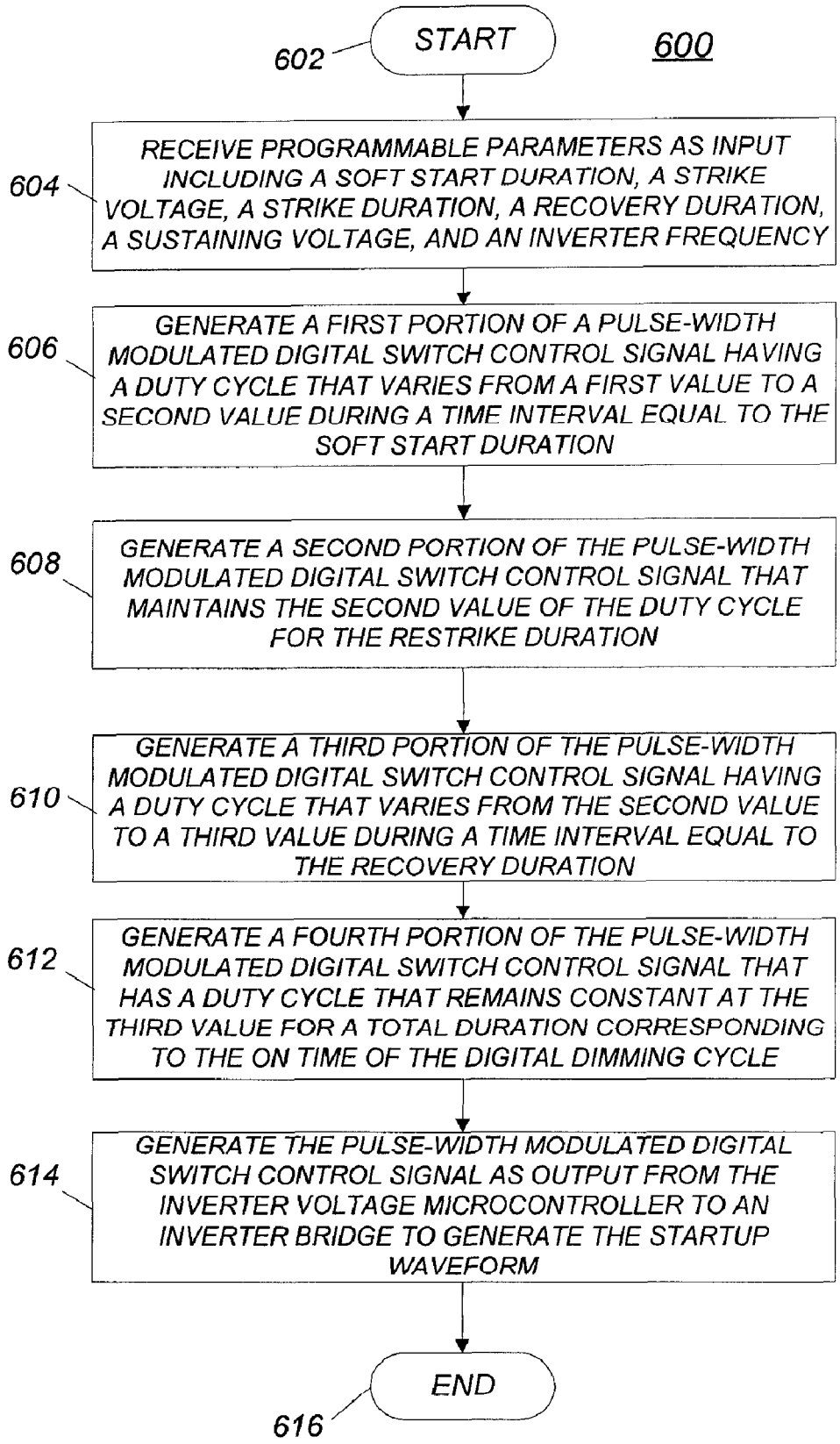
FIG. 6 illustrates a flow chart 600 for a method of generating the startup waveform of FIG. 4.

FIG. 6 illustrates a flow chart 600 for a method of generating the startup waveform of FIG. 4.

Step 602 is the entry point of the flow chart 600.

In step 604, the inverter firmware engine (IFE) receives programmable parameters as input including a soft start duration, a strike voltage, a strike duration, a recovery duration, a sustaining voltage, and an inverter frequency. The programmable parameters may be retrieved, for example, from a calibration database stored in the IFE.

In step 606, the inverter firmware engine (IFE) generates a first portion of a pulse-width modulated digital switch control signal having a frequency equal to the inverter frequency and a duty cycle that varies from a first value to a second value during a time interval equal to the soft start duration 404 in FIG. 4. For example, the first value of the duty cycle may be zero and the second value may be the strike voltage. The modulation of the duty cycle envelope from the first value to the second value may be linear or non-linear.

In step 608, the inverter firmware engine (IFE) generates a second portion of the pulse-width modulated digital switch control signal that continues from the first portion. The second portion maintains the second value of the duty cycle for the strike duration 406.

In step 610, the inverter firmware engine (IFE) generates a third portion of the pulse-width modulated digital switch control signal that continues from the second portion. The third portion has a duty cycle that varies from the second value to a third value during a time interval equal to the recovery duration 408. The third value of the duty cycle is selected to generate the sustaining voltage.

In step 612, the inverter firmware engine (IFE) generates a fourth portion of the pulse-width modulated digital switch control signal that continues from the third pulse-width modulated digital switch control signal. The fourth portion has a duty cycle that remains constant at the third value.

In step 614, the inverter firmware engine (IFE) generates the first, second, third, and fourth portions of the pulse-width modulated digital switch control signal as output from the inverter voltage microcontroller to an inverter bridge to generate the digital dimming waveform.

Step 616 is the exit point of the flow chart 600.

Although the flowcharts described above show specific stops performed in a specific order, these steps may be combined, sub-divided, or reordered within the scope of the appended claims. Unless specifically indicated, the order and grouping of steps is not a limitation of other embodiments that may lie within the scope of the claims.

The flow charts described above for the IFE and the AFE may be embodied in a disk, a CD-ROM, and other tangible computer readable media for loading and executing on a computer according to well-known computer programming techniques.

While the embodiments described above are generally intended for an array of fluorescent lamps, other embodiments may also be practiced within the scope of the appended claims for other electrical loads.

The specific embodiments and applications thereof described above are for illustrative purposes only and do not preclude modifications and variations that may be made within the scope of the following claims.

What is claimed is:

1. A method, comprising:

receiving one or more lamp array parameters associated with a lamp array;

generating a control signal based on the one or more lamp array parameters, wherein the control signal is configured to provide a first transition voltage having a peak amplitude that is less than a strike voltage amplitude of the lamp array and a second transition voltage having a peak amplitude that is less than the strike voltage amplitude and greater than a sustaining voltage amplitude of the lamp array; and controlling the lamp array based on the control signal.

2. The method of claim 1, wherein said generating further comprises generating the control signal to provide a strike voltage having a peak amplitude of at least the strike voltage amplitude of the lamp array, and wherein the peak amplitude of the strike voltage is maintained for a strike duration.

3. The method of claim 1, wherein said generating further comprises generating the control signal to provide a sustaining voltage having a peak amplitude of at least the sustaining voltage amplitude, and wherein the peak amplitude of the sustaining voltage is maintained for a period of time.

4. The method of claim 1, wherein said generating comprises generating a digital dimming control signal.

5. The method of claim 1, wherein said generating comprises generating a digital startup control signal.

6. The method of claim 1, wherein said receiving comprises receiving at least one lamp array parameter from a group consisting of: a soft start duration, a strike voltage, a strike duration, a recovery duration, a sustaining voltage, a dimming duty cycle, and an inverter frequency.

7. The method of claim 1, wherein said generating further comprises controlling a duty cycle of a pulse-width modulated digital-switch control signal.

8. An apparatus, comprising:

an inverter configured to control brightness in a lamp array; and an inverter controller coupled to the inverter, wherein the inverter controller is configured to generate a control signal for the inverter based on one or more lamp array parameters, and wherein the control signal is configured to provide a first transition voltage with a peak amplitude that is less than a strike voltage amplitude of the lamp array and a second transition voltage with a peak amplitude that is less than the strike voltage amplitude and greater than a sustaining voltage amplitude of the lamp array.

9. The apparatus of claim 8, further comprising:

a memory coupled to the inverter controller, wherein the memory is configured to store the one or more lamp array parameters; and a lamp array coupled to the inverter.

10. The apparatus of claim 8, wherein the lamp array comprises a cold-cathode fluorescent lamp.

11. The apparatus of claim 8, wherein the lamp array comprises an external-electrode fluorescent lamp.

12. An article of manufacture including a computer-readable medium having instructions stored thereon that, if executed by a computing device, cause the computing device to perform operations comprising:

receiving one or more lamp array parameters associated with a lamp array;

generating a control signal based on the one or more lamp array parameters, wherein the control signal is configured to provide a first transition voltage having a peak amplitude that is less than a strike voltage amplitude of the lamp array and a second transition voltage having a peak amplitude that is less than the strike voltage amplitude and greater than a sustaining voltage amplitude of the lamp array; and controlling the lamp array based on the control signal.

13. The article of manufacture of claim 12, wherein said generating further comprises generating the control signal to provide a strike voltage having a peak amplitude of at least the strike voltage amplitude of the lamp array, and wherein the peak amplitude of the strike voltage is maintained for a strike duration.

14. The article of manufacture of claim 12, wherein said generating further comprises generating the control signal to provide a sustaining voltage having a peak amplitude of at least the sustaining voltage amplitude, and wherein the peak amplitude of the sustaining voltage is maintained for a period of time.

15. The article of manufacture of claim 12, wherein said receiving comprises receiving at least one lamp array parameter from a group consisting of: a soft start duration, a strike voltage, a strike duration, a recovery duration, a sustaining voltage, a dimming duty cycle, and an inverter frequency.

16. The article of manufacture of claim 12, wherein said generating further comprises controlling a duty cycle of a pulse-width modulated digital-switch control signal.

17. An apparatus, comprising:

means for receiving one or more lamp array parameters associated with a lamp array;

means for generating a control signal based on the one or more lamp array parameters, wherein the control signal is configured to provide a first transition voltage having a peak amplitude that is less than a strike voltage amplitude of the lamp array and a second transition voltage having a peak amplitude that is less than the strike voltage amplitude and greater than a sustaining voltage amplitude of the lamp array; and means for controlling the lamp array based on the control signal.

18. A method comprising:

receiving, by an inverter controller, one or more parameters associated with a lamp array, wherein the one or more parameters include a transition duration; and generating, by the inverter controller, a control signal to transition an inverter voltage from having a first peak amplitude to having a second peak amplitude over the transition duration.

19. The method of claim 18, wherein the transition duration is a first transition duration, wherein the one or more parameters further comprise a second transition duration, and wherein said generating further comprises:

generating the control signal to further transition the inverter voltage from having the second peak amplitude to having a third peak amplitude over the second transition duration, wherein the second peak amplitude is greater than each of the first and third peak amplitudes.

20. The method of claim 19, wherein the second peak amplitude is at least a strike voltage amplitude of the lamp array, and wherein the third peak amplitude is a sustained voltage amplitude of the lamp array.

21. The method of claim 19, wherein said generating further comprises:

generating the control signal to have a first duty cycle for the first transition duration to transition the inverter voltage from having the first peak amplitude to having the second peak amplitude; and generating the control signal to have a second duty cycle for the second transition duration to transition the inverter voltage from having the second peak amplitude to having the third peak amplitude.

22. An apparatus comprising:

an inverter configured to provide an inverter voltage; and an inverter controller coupled to the inverter and configured to:

receive one or more parameters associated with a lamp array, wherein the one or more parameters include a transition duration; and generate a control signal to control the inverter to transition an inverter voltage from having a first peak amplitude to having a second peak amplitude over the transition duration.

23. The apparatus of claim 22, wherein the transition duration is a first transition duration, wherein the one or more parameters further comprise a second transition duration, and wherein the inverter controller is further configured to:

generate the control signal to control the inverter to further transition the inverter voltage from having the second peak amplitude to having a third peak amplitude over the second transition duration, wherein the second peak amplitude is greater than each of the first and third peak amplitudes.

24. The apparatus of claim 22, wherein the second peak amplitude is at least a strike voltage amplitude of the lamp array, and wherein the third peak amplitude is a sustained voltage amplitude of the lamp array.

25. The apparatus of claim 22, wherein the inverter controller is further configured to:

generate the control signal to have a first duty cycle for the first transition duration to control the inverter to transition the inverter voltage from having the first peak amplitude to having the second peak amplitude; and generate the control signal to have a second duty cycle for the second transition duration to control the inverter to transition the inverter voltage from having the second peak amplitude to having the third peak amplitude.

26. An article of manufacture including a computer-readable medium having instructions stored thereon that, if executed by a computing device, cause the computing device to perform operations comprising:

receiving one or more parameters associated with a lamp array, wherein the one or more parameters include a transition duration; and generating a control signal to transition an inverter voltage from having a first peak amplitude to having a second peak amplitude over the transition duration.

27. The article of manufacture of claim 26, wherein the transition duration is a first transition duration, wherein the one or more parameters further comprise a second transition duration, and wherein said generating further comprises:

generating the control signal to further transition the inverter voltage from having the second peak amplitude to having a third peak amplitude over the second transition duration, wherein the second peak amplitude is greater than each of the first and third peak amplitudes.

28. The article of manufacture of claim 26, wherein the second peak amplitude is at least a strike voltage amplitude of the lamp array, and wherein the third peak amplitude is a sustained voltage amplitude of the lamp array.

29. The article of manufacture of claim 26, wherein said generating further comprises:

generating the control signal to have a first duty cycle for the first transition duration to transition the inverter voltage from having the first peak amplitude to having the second peak amplitude; and generating the control signal to have a second duty cycle for the second transition duration to transition the inverter voltage from having the second peak amplitude to having the third peak amplitude.

* * * * *